US012723201B2

(12) United States Patent
Andersen et al.

(10) Patent No.: US 12,723,201 B2
(45) Date of Patent: Sep. 1, 2026

(54) PROCESS FOR STABILIZATION OF REACTIVE LIQUID FEEDSTOCK

(71) Applicant: Topsoe A/S, Kgs. Lyngby (DK)

(72) Inventors: Stefan Andersen, Værløse (DK); Magnus Zingler Stummann, Copenhagen (DK)

(73) Assignee: TOPSOE A/S, Kgs. Lyngby (DK)

( * ) Notice: Subject to any disclaimer, the term of this patent is extended or adjusted under 35 U.S.C. 154(b) by 184 days.

(21) Appl. No.: 18/704,141

(22) PCT Filed: Nov. 3, 2022

(86) PCT No.: PCT/EP2022/080653

§ 371 (c)(1),
(2) Date: Apr. 24, 2024

(87) PCT Pub. No.: WO2023/078983

PCT Pub. Date: May 11, 2023

(65) Prior Publication Data

US 2024/0409818 A1 Dec. 12, 2024

(30) Foreign Application Priority Data

Nov. 3, 2021 (EP) ..... 21206138

(51) Int. Cl.
*C10G 3/00* (2006.01)
*C10G 65/04* (2006.01)

(52) U.S. Cl.
CPC ..... *C10G 3/50* (2013.01); *C10G 3/42* (2013.01); *C10G 3/60* (2013.01); *C10G 65/04* (2013.01); *C10G 2300/202* (2013.01)

(58) Field of Classification Search
CPC ... C10G 3/00; C10G 3/50; C10G 3/42; C10G 3/60; C10G 65/04; C10G 2300/202;
(Continued)

(56) References Cited

U.S. PATENT DOCUMENTS 3,208,201 A 9/1965 Oliver
9,068,126 B2 * 6/2015 Baird ..... C10G 3/42
(Continued)

FOREIGN PATENT DOCUMENTS

BE 737389 A 1/1970
EP 2036970 A2 3/2009
(Continued)

OTHER PUBLICATIONS

International Search Report mailed on Feb. 10, 2023, by the European Patent Office for International Application No. PCT/EP2022/080653 5 Pages.
(Continued)

*Primary Examiner* — Ellen M Mcavoy
(74) *Attorney, Agent, or Firm* — Boone IP Law

(57) ABSTRACT

A process and a process plant for conversion of a reactive liquid feedstock stream containing at least 40 wt % carbon, including the steps of directing a diluent stream, having a first combined hydrogen consumption potential and the reactive liquid feedstock stream as a combined stream having a first hydrogen consumption potential, to contact a material catalytically active in hydrotreatment which during operation has a lowest temperature of at least 80° C. and a highest temperature of less than 250° C. in the presence of dihydrogen, withdrawing a stabilized composition stream having a second combined hydrogen consumption potential which is less than 80% and more than 10% of the first hydrogen consumption potential, and providing an amount of the liquid phase of said stabilized composition stream as said diluent stream wherein the hydrogen consumption potential for a composition is the amount of hydrogen required for conversion of the composition into a saturated hydrocarbon.

13 Claims, 3 Drawing Sheets

(58) Field of Classification Search
CPC ..... C10G 45/32; C10G 2300/4081; C10G 2300/802; Y02P 30/20
See application file for complete search history.

(56) References Cited

U.S. PATENT DOCUMENTS

| | | | | |
|---|---|---|---|---|
| 9,163,181 | B2 * | 10/2015 | Baird | C10G 3/40 |
| 2013/0152454 | A1 | 6/2013 | Baird | |
| 2013/0255138 | A1 | 10/2013 | Mayeur | |
| 2016/0130509 | A1 * | 5/2016 | Nousiainen | C10G 3/46 585/324 |
| 2017/0037325 | A1 * | 2/2017 | Ackerson | C10G 45/04 |
| 2024/0327721 | A1 * | 10/2024 | Gabrielsen | C10G 3/42 |
| 2025/0084316 | A1 * | 3/2025 | Andersen | C10G 3/60 |

FOREIGN PATENT DOCUMENTS

| | | | | |
|---|---|---|---|---|
| RU | 2495082 | C2 | 10/2012 | |
| RU | 2630774 | C1 | 9/2017 | |
| WO | 2010028717 | A2 | 3/2010 | |
| WO | 2013191788 | A1 | 12/2013 | |
| WO | 2017218577 | A1 | 12/2017 | |
| WO | WO-2022233688 | A1 * | 11/2022 | C10G 69/06 |

OTHER PUBLICATIONS

European Search Report mailed on Apr. 22, 2022 by the European Patent Office for European Application No. EP21206138.6, 10 Pages.

Written Opinion mailed on Feb. 10, 2023, by the European Patent Office for International Application No. PCT/EP2022/080653, 10 Pages.

Office Action issued by the European Patent Office on Aug. 11, 2025, in European Application No. 22817525.3, 10 pages.

Federal Service for Intellectual Property Federal State Budgetary Institution Substantive Examination for Application No. 2024114922/04(033660) dated Nov. 3, 2022, 18 pages.

Federal Service for Intellectual Property Search Report for Application No. 2024114922/04(033660) dated Nov. 3, 2022, 4 pages.

* cited by examiner

PROCESS FOR STABILIZATION OF REACTIVE LIQUID FEEDSTOCK

The present invention relates to a process for conversion of a reactive liquid feedstock.

Transportation fuels and petrochemical feedstock may be produced from renewable feedstocks, including waste products, side products and recycled products, to increase the environmental sustainability. Typically, such renewable feedstocks are rich in oxygenates, and commonly they are highly reactive, especially if originating from thermal decomposition processes such as pyrolysis, hydrothermal liquefaction and other processes where solids are converted to liquids.

Unfortunately, the reactive liquid feedstock originating from these processes may be difficult to process. The reactive liquid feedstock may comprise olefins and reactive oxygenates, which are prone to polymerization and solidification under the conditions of operation.

The conversion of the reactive liquid feedstock may be related to extensive heat release which for renewable feedstock based on e.g. triglycerides has been handled by recycle of product.

However, recycle increases the volume of all process equipment between the point where the recycle stream is let in to the point where it is withdrawn, as well as the energy required for pumping these increased process volumes.

It has now been realized that the benefits of recycle may be realized if a high recycle ratio is introduced for an initial reactor only, without causing a related increase of process equipment size for the remainder of the process.

As used herein, the term hydrogen consumption potential for a composition shall be understood as the amount of hydrogen required for conversion of the composition into a saturated hydrocarbon. As an example, oleic acid, $CH_3(CH_2)_7CH{=}CH(CH_2)_7COOH$ (fw=282.5 g/mol) may react with $4H_2$ molecules according to the following:

$$CH_3(CH_2)_7CH{=}CH(CH_2)_7COOH+3H_2{=}CH_3(CH)_{16}CH_3+2H_2O$$

The hydrogen consumption potential thus equals 28 g/kg for oleic acid. For a mixed stream the hydrogen consumption potential is only considered for molecules with at least 5 carbon atoms.

As used herein, the term "thermal decomposition" shall for convenience be used broadly for any decomposition process, in which a material is partially decomposed at elevated temperature (typically 250° C. to 800° C. or even 1000° C.), in the presence of substoichiometric amount of oxygen (including no oxygen). The product will typically be a combined liquid and gaseous stream, as well as an amount of solid char. The term shall be construed to at least include processes known as pyrolysis and hydrothermal liquefaction, both in the presence and absence of a catalyst.

As used herein, the term a reactive liquid feedstock shall be construed as a feedstock comprising oxygenates and/or olefins. Such a reactive liquid feedstock may be prone to react even without presence of catalytically active materials, e.g. by polymerization.

For simplicity all products from thermal decomposition, such as pyrolysis and thermal liquefaction, will in the following be referred to as pyrolysis oil, irrespective of the nature of the originating process.

In the following the abbreviation $ppm_v$ shall be used to signify volumetric parts per million, e.g. molar gas concentration.

In the following the abbreviation $ppm_w$ shall be used to signify weight parts per million, e.g. the mass of sulfur atoms relative to the mass of a liquid hydrocarbon stream.

In the following the abbreviation wt % shall be used to signify weight percentage.

In the following the abbreviation vol % shall be used to signify volume percentage for a gas.

Where concentrations in the gas phase are given, they are, unless otherwise specified, given as molar concentration.

Where concentrations in liquid or solid phase are given, they are, unless otherwise specified given as wt concentration.

The aromatic content of a liquid is in accordance with the art the total mass of molecules having at least one aromatic structure, relative to the total mass of all molecules in %.

A first aspect of the present disclosure relates to a process for conversion of a reactive liquid feedstock stream containing at least 40 wt % carbon into a stabilized composition, comprising the steps of a. directing a diluent stream and the reactive liquid feedstock stream as a combined stream having a first hydrogen consumption potential, to contact a material catalytically active in hydrotreatment which during operation has a lowest temperature of at least 80° C. and a highest temperature of less than 250° C. in the presence of dihydrogen,
b. withdrawing a stabilized composition stream having a second hydrogen consumption potential which is less than 80%, less than 60% and more than 40% or more than 20% or more than 10% of the first hydrogen consumption potential,
c. providing an amount of the liquid phase of said stabilized composition stream as said diluent stream wherein the hydrogen consumption potential for a composition shall be understood as the amount of hydrogen required for conversion of the composition into a saturated hydrocarbon.

This has the associated benefit of the diluent being only partly converted, as it still has a hydrogen consumption potential of 10% to 80% compared to the combined stream, and thus having a chemical nature favoring miscibility with the reactive feedstock, such that material catalytically active in hydrotreatment is contacted with a mixed liquid which is uniform, and which due to the dilution is less prone to polymerization and has a higher heat capacity, relative to the reactivity.

A second aspect of the present disclosure relates to a process according to any aspect above, in which the reactive liquid feedstock stream contains at least 5 wt % O, at least 10 wt % O or at least 25 wt % O. This has the associated benefit of such reactive liquid feedstock being representative of fuel and chemical precursors of renewable origin. Commonly the reactive liquid feedstock stream contains less than 35 wt % O 50 wt % O.

A third aspect of the present disclosure relates to a process according to any aspect above, in which the reactive liquid feedstock stream has a carbonyl content of at least 0.5 mol/kg, at least 1.0 mol/kg or at least 2.5 mol/kg. This has the associated benefit of such reactive liquid feedstock being representative of fuel and chemical precursors of renewable origin.

A fourth aspect of the present disclosure relates to a process according to any aspect above, in which step a is preceded by formation of the reactive liquid feedstock stream in a thermal decomposition process, carried out in the presence or absence of a catalyst, such as thermal liquefaction, gasification, autothermal pyrolysis, hydropyrolysis, fast pyrolysis, intermediate pyrolysis or slow pyrolysis. This has the associated environmental and economic benefit of such reactive liquid feedstock being provided from a wide range of solid waste or by-products.

A fifth aspect of the present disclosure relates to a process according to any aspect above, in which a combined liquid and gas phase stream is withdrawn from the stabilized composition stream by overflow and said diluent stream is withdrawn by flow control. This has the associated benefit of such a separation being simple and inexpensive to provide, e.g. within the reactor for hydrotreatment.

A sixth aspect of the present disclosure relates to a process according to any aspect above, in which the diluent stream is directed as driven fluid to an ejector pump which receives a pressurized reactive liquid feedstock stream as motive fluid. This has the associated benefit of an ejector pump being mechanically simple and providing mixing of diluent and reactive liquid feedstock inherently.

A seventh aspect of the present disclosure relates to a process according to any aspect above, in which the total weight ratio between diluent stream and reactive liquid feedstock stream is at least 1:1, such as 2:1 or 3:1 or 4:1. This has the associated benefit of a high amount of diluent limiting the polymerization and providing an increased heat capacity as a heat sink.

An eighth aspect of the present disclosure relates to a process according to any aspect above, in which the combined diluent stream and reactive liquid feedstock stream is directed to contact the material catalytically active in hydrotreatment which during operation has a lowest temperature, sufficient for initiating exothermal hydrogenation, such as at least 80° C., at least 150° C. or at least 200° C. and a sufficiently low temperature to avoid thermal runaway hydrocracking such as less than 280° C., less than 200° C. or less than 180° C., prior to being combined with the reactive liquid feedstock stream. This has the associated benefit of providing a mixture having sufficient temperature for the hydrotreatment reaction, while still limiting the maximum temperature. For pyrolysis oil the inlet temperature would commonly be 80-180° C., for the less reactive pyrolysis oil from catalytic pyrolysis and hydrothermal liquefaction 125-200° C. and for more stable products the inlet temperature may be 200-280° C. The lowest temperature of the catalytically active material is typically at the inlet of the reactor.

A ninth aspect of the present disclosure relates to a process according to any aspect above, in which the diluent stream is cooled prior to being combined with the reactive liquid feedstock stream. This has the associated benefit of providing a heat sink for taking up released heat from the hydrotreatment reaction, while avoiding thermal reaction of the mixture.

A tenth aspect of the present disclosure relates to a process according to any aspect above, in which a stream comprising an amount of the liquid phase of said stabilized composition is directed to contact a further material catalytically active in hydrotreatment to provide a further hydrotreated composition optionally after combination with a further diluent stream having a hydrogen consumption potential below that of the stabilized composition stream. This has the associated benefit of further converting the stabilized composition towards a hydrocarbon and if further diluted, of limiting the heat released while matching the stabilized composition with the further diluent used.

A eleventh aspect of the present disclosure relates to a process according to any aspect above, in which the further hydrotreated composition stream is directed to contact a material catalytically active in hydroprocessing, such as hydrocracking or isomerization, optionally after withdrawal of a gas phase stream and combination with an amount of dihydrogen to provide a hydroprocessed hydrocarbon product stream. This has the associated benefit of adjusting the product structure or molecular weight to the hydroprocessed hydrocarbon product requirements. As such hydroprocessing is often carried out in the presence of catalytically active material comprising noble metals and molecular sieves, removal of $H_2S$, $NH_3$, CO and $CO_2$ may be preferred.

A twelfth aspect of the present disclosure relates to a process plant configured for receiving a reactive liquid feedstock, configured for receiving an amount of dihydrogen and configured for providing a stabilized composition, said process plant comprising a first hydrotreatment reactor having an inlet and an outlet, a second hydrotreatment reactor having an inlet and an outlet and a means of liquid propulsion having an inlet and an outlet, wherein reactive liquid feedstock is directed to the inlet of the first hydrotreatment reactor and wherein the outlet of the first hydrotreatment reactor is in fluid communication with the inlet of the means of liquid propulsion and with the inlet of the second hydrotreatment reactor, where the outlet of the means of liquid propulsion is in fluid communication with the inlet of the first hydrotreatment reactor and where a further hydrotreated composition is provided from the outlet of the second hydrotreatment reactor. This has the associated benefit of providing a process plant with recycle around a first hydrotreatment reactor for stabilization and further hydrotreatment in a second hydrotreatment reactor.

A thirteenth aspect of the present disclosure relates to a process plant according to the thirteenth aspect above, wherein the means of propulsion is an ejector having a motive stream inlet, a driven stream inlet and said outlet, and wherein the reactive liquid feedstock is directed to the motive stream inlet and the fluid communication between the outlet of the first hydrotreatment reactor and the inlet of the means of liquid propulsion is to the driven stream inlet. This has the associated benefit of providing a means of liquid propulsion without moving parts which also provides mixing between reactive liquid feedstock and stabilized composition, as an alternative to a conventional electrically driven pump.

Liquid products from thermal decomposition, such as pyrolysis and thermal liquefaction, have, especially from a global warming perspective, been considered an environmentally friendly replacement for fossil products, especially after hydrotreatment. The nature of these products (for simplicity pyrolysis oil, irrespective of the originating process) will commonly be that they are rich in oxygenates and possibly olefins. The nature of formation means that the products are not stabilized, and therefore, contrary to typical fossil raw feedstocks, they may be very reactive, demanding high amounts of hydrogen, releasing significant amounts of heat during reaction and furthermore having a high propensity towards polymerization.

The release of heat may increase the polymerization further, and at elevated temperature, catalysts may also be deactivated by coking.

Other oxygenate feedstocks, including those of direct biological origin such as animal fat, vegetable oils and similar compounds, may also be similarly reactive, either due to a presence of double bonds or a presence of reactive oxygenates, and therefore the present considerations are of relevance also for these feedstocks.

Dilution of the feedstock with at least partially hydrotreated product could in theory provide a heat sink for collecting released heat. Furthermore, by diluting the reactive species, the kinetics of polymerization are slowed down.

The thermal decomposition process plant section providing the feedstock according to the present disclosure may be in the form of a fluidized bed, transported bed, circulating fluid bed or an auger reactor, as is well known in the art. This decomposition converts a pyrolysis feedstock into a solid (char), a high boiling liquid (tar) and fraction being gaseous at elevated temperatures. The gaseous fraction comprises a fraction condensable at standard temperature (pyrolysis oil or condensate, C5+ compounds) and a non-condensable fraction (pyrolysis gas, including pyrolysis off-gas). For instance, the thermal decomposition process plant section (the pyrolysis section) may comprise a pyrolizer unit (pyrolysis reactor), cyclone(s) to remove particulate solids such as char, and a cooling unit for thereby producing pyrolysis off-gas stream and said pyrolysis oil stream, i.e. condensed pyrolysis oil. The pyrolysis off-gas stream comprises light hydrocarbons e.g. C1-C4 hydrocarbons, $H_2O$, CO and $CO_2$. Typically, the term pyrolysis oil comprises condensate and tar, and the pyrolysis oil stream from pyrolysis of biomass may also be referred to as bio-oil and is a liquid substance rich in blends of molecules usually consisting of more than two hundred different compounds mainly oxygenates such as acids, sugars, alcohols, phenols, guaiacols, syringols, aldehydes, ketones, furans, and other mixed oxygenates, resulting from the depolymerisation of the solids treated in pyrolysis.

For the purposes of the present invention, the pyrolysis section may be fast pyrolysis, also referred to in the art as flash pyrolysis. Fast pyrolysis means the thermal decomposition of a solid renewable feedstock typically in the absence of oxygen, at temperatures typically in the range 350-650° C. e.g. about 500° C. and reaction times of 10 seconds or less, such as 5 seconds or less, e.g. about 2 sec. Fast pyrolysis may for instance be conducted by autothermal operation e.g. in a fluidized bed reactor. The latter is also referred to as autothermal pyrolysis and is characterized by employing air, optionally with an inert gas or recycle gas, as the fluidizing gas. Thereby, the partial oxidation of pyrolysis compounds being produced in the pyrolysis reactor (autothermal reactor) provides the energy for pyrolysis while at the same time improving heat transfer. In so-called catalytic fast pyrolysis, a catalyst may be used. An acid catalyst may be used to upgrade the pyrolysis vapors, and it can both be operated in an in-situ mode (the catalyst is located in the pyrolysis reactor) and an ex-situ mode (the catalyst is placed in a separate reactor). The use of a catalyst conveys the advantage of removing oxygen and thereby helping to stabilize the pyrolysis oil, thus making it easier to hydroprocess. In addition, increased selectivity towards desired pyrolysis oil compounds may be achieved.

In some cases, hydrogen is added to the catalytic pyrolysis which is called reactive catalytic fast pyrolysis. If the catalytic pyrolysis is conducted at a high hydrogen pressure (such as above 500 kPa) it is often called catalytic hydropyrolysis.

The pyrolysis stage may alternatively be fast pyrolysis conducted without the presence of a catalyst and hydrogen, i.e. the fast pyrolysis stage may not be catalytic fast pyrolysis, hydropyrolysis or catalytic hydropyrolysis. This enables a much simpler and inexpensive process.

The thermal decomposition section may also be hydrothermal liquefaction. Hydrothermal liquefaction means the thermochemical conversion of biomass into liquid fuels by processing in a hot, pressurized water environment for sufficient time to break down the solid bio polymeric structure to mainly liquid components. Typical hydrothermal processing conditions are temperatures in the range of 250-375° C. and operating pressures in the range of 4-22 MPa. This technology offers the advantage of operation of a lower temperature, higher energy efficiency and producing a product with a lower oxygen content compared to pyrolysis, e.g. fast pyrolysis.

Finally, other relevant thermal decomposition methods are intermediate or slow pyrolysis, in which the conditions involve a lower temperature and commonly higher residence times—these methods may also be known as carbonization or torrefaction. The major benefit of these thermal decomposition methods is a lower investment, but they may also have specific benefits for specific feedstocks or for specific product requirements, such a need for bio-char.

The conversion of oxygenates to hydrocarbons is a common process for production of renewable transportation fuels, but the reactivity and other specifics differ for different feedstocks. The oxygenate feedstock typically comprises one or more oxygenates taken from the group consisting of triglycerides, fatty acids, resin acids, ketones, aldehydes or alcohols where said oxygenates may originate from one or more of a biological source and a thermal and/or catalytic degradation process, including a gasification process or a pyrolysis process, such that a wide range of feedstocks, especially of renewable origin may be converted into hydrocarbons. This includes feedstocks originating from plants, algae, animals, fish, vegetable oil refining, other biological sources, domestic waste, industrial biological waste like tall oil or black liquor as well as non-biological waste comprising suitable compositions, such as plastic fractions or rubber, including used tires, typically after a thermal and/or catalytic degradation process. In addition, oxygenates may be provided synthetically, typically from a fossil or renewable synthesis gas via Fischer-Tropsch synthesis. When the feedstock is of biological origin, the feedstock and the product will be characterized by having a 14C content above 0.5 parts per trillion of the total carbon content, but when the feedstock includes waste of fossil origin, such as plastic, this ratio may be different.

The production of hydrocarbon products typically requires one or more hydroprocessing steps which most commonly are; hydrotreatment for removing heteroatoms and saturating double bonds, hydroisomerization for adjusting hydrocarbon molecule structure and hydrocracking for reducing hydrocarbon molecular weight.

During hydrotreatment, oxygenates are combined with an excess of hydrogen and react in hydrodeoxygenation processes as well as in decarboxylation and decarbonylation processes, where water, carbon dioxide and carbon monoxide are released from the oxygenates, and an amount of carbon dioxide is converted to carbon monoxide by the water/gas shift process. Typically, from 5 wt % or 10 wt % to 50 wt % of the oxygenate feedstock is oxygen, and thus a significant amount of the product stream will be water, carbon dioxide and carbon monoxide. In addition, an amount of light hydrocarbons (especially methane and propane) may also be present in the product stream, depending on the nature of the feedstock and the side reactions occurring. Hydrotreatment may also involve extraction of other hetero-atoms, notably nitrogen and sulfur but possibly also halogens and silicon as well as saturation of double bonds. Especially the hydrotreatment of oxygenates is very reactive and exothermal, and moderate or low activity catalysts may be preferred to avoid excessive heat release and runaway reactions resulting in coke formation deactivating the catalyst. The catalyst activity is commonly controlled by only using low amounts of active metals and especially limiting the amount of promoting metals, such as nickel and cobalt.

Typically, hydrotreatment, such as deoxygenation and hydrogenation, involves directing the feedstock stream comprising oxygenates to contact a catalytically active material comprising sulfided molybdenum, or possibly tungsten, and/or nickel or cobalt, supported on a carrier comprising one or more refractory oxides, typically alumina, but possibly silica or titania. The support is typically amorphous. The catalytically active material may comprise further components, such as boron or phosphorous. The conditions are typically a temperature in the interval 250-400° C., a pressure in the interval 3-15 MPa, and a liquid hourly space velocity (LHSV) in the interval 0.1-2. The deoxygenation will involve a combination of hydrodeoxygenation producing water and if the oxygenates comprise carboxylic groups such as acids or esters, decarboxylation producing $CO_2$. The deoxygenation of carboxylic groups may proceed by hydrodeoxygenation or decarboxylation with a selectivity which, depending on conditions and the nature of the catalytically active material may vary from above 90% hydrodeoxygenation to above 90% decarboxylation. Deoxygenation by both routes is exothermal, and with the presence of a high amount of oxygen, the process may involve intermediate cooling e.g. by quenching with cold hydrogen, feed or product. The feedstock may preferably contain an amount of sulfur to maintain sulfidation of the metals, in order to maintain their activity. If the feedstock stream comprising oxygenates comprises less than 10, 100 or 500 $ppm_w$ sulfur, a sulfide donor, such as dimethyldisulfide (DMDS) has typically been added to the feed.

If the unstabilized feedstock is highly reactive, a pre-treatment at moderate conditions may be relevant, to stabilize the feedstock. This may involve an inlet temperature as low as 80° C., 120° C. or 200° C., a pressure in the interval 3-15 MPa, and a liquid hourly space velocity (LHSV) in the interval 0.1-2 and a deliberate choice of less active catalytically active material, such as unpromoted molybdenum. Due to the reactive components and the exothermal nature thermal control may be relevant in this pre-treatment step.

Under the conditions in the HDO reactor, the equilibrium of the water gas shift process causes a conversion of $CO_2$ and $H_2$ to CO and $H_2O$. In the presence of the base metal catalyst an amount of methanation may take place, converting CO and $H_2$ to $CH_4$ and $H_2O$.

Especially when treating fatty acids, triglycerides and Fischer-Tropsch products, the deoxygenation process may provide a product rich in linear alkanes, having poor cold flow properties, and therefore the deoxygenation process may be combined with a hydroisomerization process, with the aim of improving the cold flow properties of products, and/or a hydrocracking process, with the aim of adjusting the boiling point of products.

Typically, rearrangement of molecular structure by hydroisomerization involves directing an intermediate deoxygenated product stream feedstock to contact a material catalytically active in hydroisomerization comprising an active metal (either elemental noble metals such as platinum and/or palladium or sulfided base metals such as nickel, cobalt, tungsten and/or molybdenum), an acidic support (typically a molecular sieve showing high shape selectivity, and having a topology such as MOR, FER, MRE, MWW, AEL, TON and MTT) and a refractory support (such as alumina, silica or titania, or combinations thereof). The catalytically active material may comprise further components, such as boron or phosphorous. The conditions are typically a temperature in the interval 250-350° C., a pressure in the interval 2-10 MPa, and a liquid hourly space velocity (LHSV) in the interval 0.5-8. Isomerization is substantially thermally neutral and hydrogen is typically not consumed in the isomerization reaction, although a minor amount of hydrocracking side reactions consuming hydrogen may occur. The active metal on the material catalytically active in isomerization may either be a sulfided base metal or a reduced noble metal. Noble metals are active at lower temperatures and the operation at lower temperature also means a lower extent of hydrocracking and related yield loss. If it is a noble metal, the deoxygenated feedstock is typically purified by gas/liquid separation section often involving a stripping process, which typically will use hydrogen as stripping medium, but other stripping media such as steam may also be used, to reduce the content of sulfur to below 1-10 $ppm_w$. If the active metal is a base metal, the feed to hydroisomerization may preferably contain an amount of sulfur to maintain sulfidation of the metals, in order to maintain their activity.

Hydrocracking will adjust the cold flow properties as well as the boiling point characteristics of a hydrocarbon mixture, by cracking large molecules into smaller. Typically, hydrocracking involves directing an intermediate feedstock to contact a material catalytically active in hydrocracking comprising an active metal (either elemental noble metals such as platinum and/or palladium or sulfided base metals such as nickel, cobalt, tungsten and/or molybdenum), an acidic support (typically a molecular sieve showing high cracking activity, and having a topology such as MFI, BEA and FAU) and a refractory support (such as alumina, silica or titania, or combinations thereof). The catalytically active material may comprise further components, such as boron or phosphorous. While this overall composition is similar to the material catalytically active isomerization the difference is typically the nature of the acidic support, which may be of a different structure (even amorphous silica-alumina) or have a different-typically higher-acidity e.g. due to silica: alumina ratio. The conditions are typically a temperature in the interval 250-400° C., which typically is a higher temperature than corresponding isomerization temperature, a pressure in the interval 3-15 MPa, and a liquid hourly space velocity (LHSV) in the interval 0.5-8, optionally together with intermediate cooling by quenching with cold hydrogen, feed or product.

The composition of pyrolysis oils is defined by the raw material as well as the pyrolysis process. For many pyrolysis processes this means that the pyrolysis oil contains only a moderate amount of high boiling material, and therefore the required hydrocracking conditions may be moderate, and involve little or no recycle. However, some thermal decomposition processes may provide pyrolysis oil with a significant amount of product boiling above 350° C., and thus may require product recycle to obtain sufficient hydrocracking.

A hydroprocessed stream comprising hydrocarbons, excess hydrogen and inorganic molecules comprising heteroatoms must be separated in hydrocarbons and molecules—typically gases—comprising heteroatoms. To do this, the hydroprocessed stream is directed to a separation section, which for process scenarios relating to the treatment of pyrolysis oil, fatty acids and triglycerides typically either will be between a base metal based hydrotreatment reactor and a noble metal based hydroisomerization reactor, or if the material catalytically active in hydroisomerization comprises base metals, downstream the hydroisomerization reactor. The process may also comprise one or more other conversion steps, such as hydrocracking or hydrodearomatization, and depending on the sequence of these steps and the catalytically active metals used, the skilled person will be aware of the possible positions for introducing a separation section with the purpose of withdrawing a recycle gas stream.

With the present disclosure, we propose an alternative layout, in which an initial stabilization reactor for hydrogenation is provided and recycle is provided around this stabilization reactor. Such an initial reactor may operate at reduced temperature, such that only the most reactive species will react in this reactor, but nevertheless a significant fraction of the thermal release in the process may take place in this reactor. The stabilized composition released from the stabilization reactor, may then be split in a fraction for recycle and a fraction for further hydrotreatment. The recycle may either be driven by a pump or an ejector. An ejector has the benefit of being able to drive a two-phase stream, comprising gas and liquid, and furthermore containing no moving parts and by being driven by the pressure of the feedstock.

For a hydrocarbonaceous feedstock rich in oxygenates, such as Fischer-Tropsch products and hydrocarbonaceous feedstock of biological origin—especially vegetable and animal fats, the hydroprocessed stream will mainly contain long linear hydrocarbons, whereas the hydroprocessed stream from pyrolysis oil product streams may contain aromatic hydrocarbons. In addition, the stream may comprise methane, propane, water and to some extent carbon oxides, and in addition nitrogen in the hydrocarbonaceous feedstock will result in ammonia in the hydroprocessed stream. Added sulfur as well as any sulfur in the hydrocarbonaceous feedstock will be present as hydrogen sulfide in the hydroprocessed stream, and finally an excess amount of hydrogen will pass unreacted to the hydroprocessed stream.

As the development of heat and the consumption of hydrogen is high in processes treating feedstocks rich in oxygenates, the gas to oil ratio in the hydroprocessing reactors is also very high compared to other hydroprocessing processes, such as from 1000 to 7000 $Nm^3/m^3$. This hydrogen gas may be used to control process temperatures, by stepwise injections of cooled gas. The process temperature may further be regulated by recycling an amount of feedstock diluent moderately cooled to a temperature suitable for preheating the feedstock to the desired temperature without use of a heat exchanger which risk being fouled by feedstock. This recycle would at the same time provide energy for preheating the feedstock, reduce polymerization reaction rates by dilution and also provide a heat sink, such that the heat released by the exothermal hydrogenation and hydrodeoxygenation will be distributed over a larger volume. The recycle will thus require larger process equipment. Recycling has according to the prior art been driven by a pump, which necessitates that the recycle stream is a single-phase stream, to avoid cavitation of a gas phase.

Pyrolysis oil product streams may contain aromatic hydrocarbons, long linear hydrocarbons, gaseous hydrocarbons, water and to some extent carbon oxides, and in addition nitrogen in the hydrocarbonaceous feedstock will result in ammonia in the hydroprocessed stream. Added sulfur as well as any sulfur in the pyrolysis oil will be present as hydrogen sulfide in the hydroprocessed stream, and finally an excess amount of hydrogen will pass unreacted to the hydroprocessed stream. Intermediate separation steps may be required for optimal handling of this diverse mixture.

In addition, the necessity to combine 3 or 4 catalytically active materials for optimal conversion of pyrolysis oil into hydrocarbons naturally complicates the process layout, and the sequence of the materials must be considered carefully, especially concerning the presence of sulfur required for base metals and shunned for noble metals.

In the process layouts, recycle may be used for different purposes; gas recycle for efficient use of hydrogen, liquid recycle around the material catalytically active in hydrocracking to maximize the yield of the desired fraction and liquid recycle around the material catalytically active in hydrodeoxygenation to limit the temperature increase due to exothermal deoxygenation reactions as well as to limit the reaction rate of polymerization reactions for reactive oxygenates and other reactive compounds in the pyrolysis oil. The choice of recycle configuration will be related to different benefits, including process simplicity by minimizing the number of recycle loops, minimizing reactor volume and cost by choosing configurations with low recycle volumes, maximizing process reactivity control by high recycle volume and/or extensive cooling, and minimizing polymerization by high recycle volume. A further consideration with respect to recycling is the miscibility of the different compositions throughout the process.

As isomerization and hydrodearomatization may be carried out using a catalytically active material comprising noble metals, "sour gases", including hydrogen sulfide, carbon dioxide and ammonia, are removed prior to these reactions.

FIGURES

Figure 1:
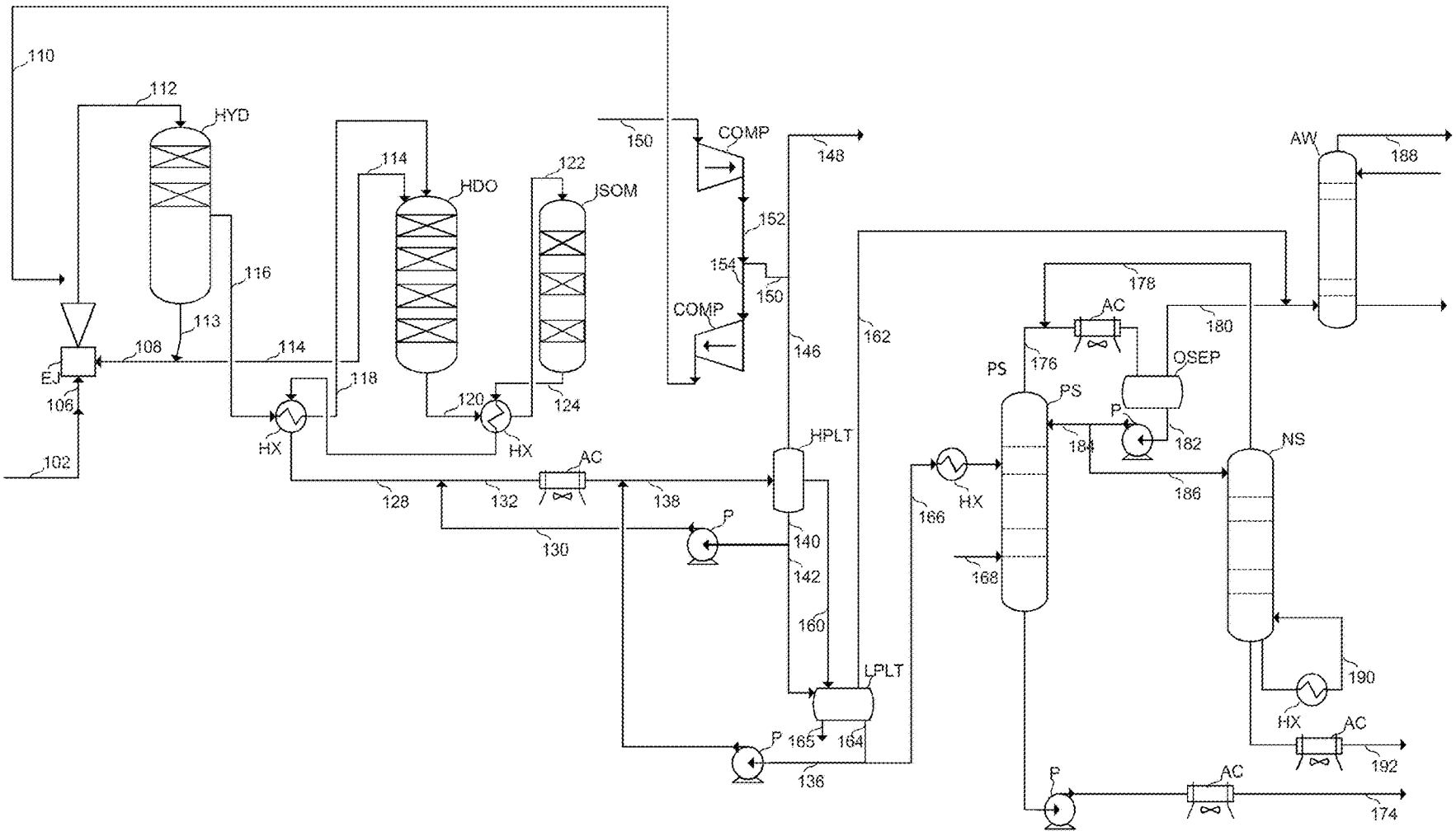
FIG. 1 shows an example of the present disclosure, with recycle around an initial stabilization reactor.

FIG. 1 shows a process layout where an amount of pressurized reactive liquid feedstock (102) is directed as feedstock for hydrogenation (106), directed as motive stream to an ejector (EJ) receiving a diluent (108) as driven stream. The ejector discharge stream is combined with an amount of hydrogen rich stream (110) and directed as stabilization inlet stream (112) to a stabilization reactor (HYD) containing an amount of material catalytically active in hydrogenation of reactive species, under moderate conditions, such as an inlet temperature of less than 200° C. and a pressure from 3 to 20 MPa depending on the nature of the reactive liquid feed. The lower part of the stabilization reactor is here configured for withdrawal of an amount of liquid stabilized composition as diluent (108), but the recycled stabilized composition may also be separated outside the stabilization reactor (HYD). An amount of two phase stabilized composition (116) is withdrawn by overflow, optionally heated and directed to further hydrotreatment in a hydrodeoxygenation reactor (HDO). The amount of overflow, may be controlled by flow control, i.e. regulation of a valve to provide a specified mass flow or volume flow of the diluent. The further hydrotreated reactive composition (120) is optionally heated and directed for hydroprocessing, here in a hydroisomerization reactor (ISOM), to provide a hydroprocessed hydrocarbon product (124), which may be cooled, here by heat exchange with inlet streams (116 and 120) to the upstream reactors (HYD and HDO). The cooled hydroprocessed hydrocarbon product (128) is combined with washing water, here a recycled amount of aqueous phase (130) to provide a mixed stream (132), from which water soluble impurities may be transferred to the aqueous phase, which is cooled and combined with an amount of recycled condensate (136). The combined stream (138) is directed to a high pressure low temperature 3 way separator (HPLT), from which the recycled amount of aqueous phase (130) and an aqueous phase (140) are withdrawn and split into sour water for further separation (142). The gas phase (146) is directed to be split in a purge stream (148) and a stream combined with pressurized make up gas (150) and directed after pressurization in a hydrogen compressor (COMP) as hydrogen rich stream (110). The hydrocarbon phase (160) is directed to a low pressure low temperature separator (LPLT) from which a sour gas stream (162), a condensate (164) and sour water for purge (165) are withdrawn. The condensate (164) is split in recycled condensate (136) and product (166) which is heated and directed to a product stripper (PS), driven by hydrogen or another stripping medium (168), and providing stripped product (174). The product stripper overhead (176) is combined with naphtha stripper overhead (178), cooled and separated in an overhead separator (OSEP), to provide an overhead gas stream (180) and an overhead condensate stream (182). The overhead condensate stream (182) is split in a product stripper reflux stream (184) directed to the product stripper (PS) and a wild naphtha stream (186), which is directed to a naphtha stripper (NS). The sour gas stream (162) from the low pressure low temperature separator and the overhead gas stream (180) are combined and directed to an amine wash (AW) or a sulfur adsorption bed releasing a sweet off-gas (188). The naphtha stripper (NS) operates by reflux, where a heated bottom stream is directed as stripping medium (190). A cooled naphtha product stream (192) is withdrawn as naphtha product. In addition to the elements listed explicitly above, heat exchangers (HX), air coolers (AC), pumps (P) and hydrogen compressors (COMP) are also depicted in the figure.

Figure 2:
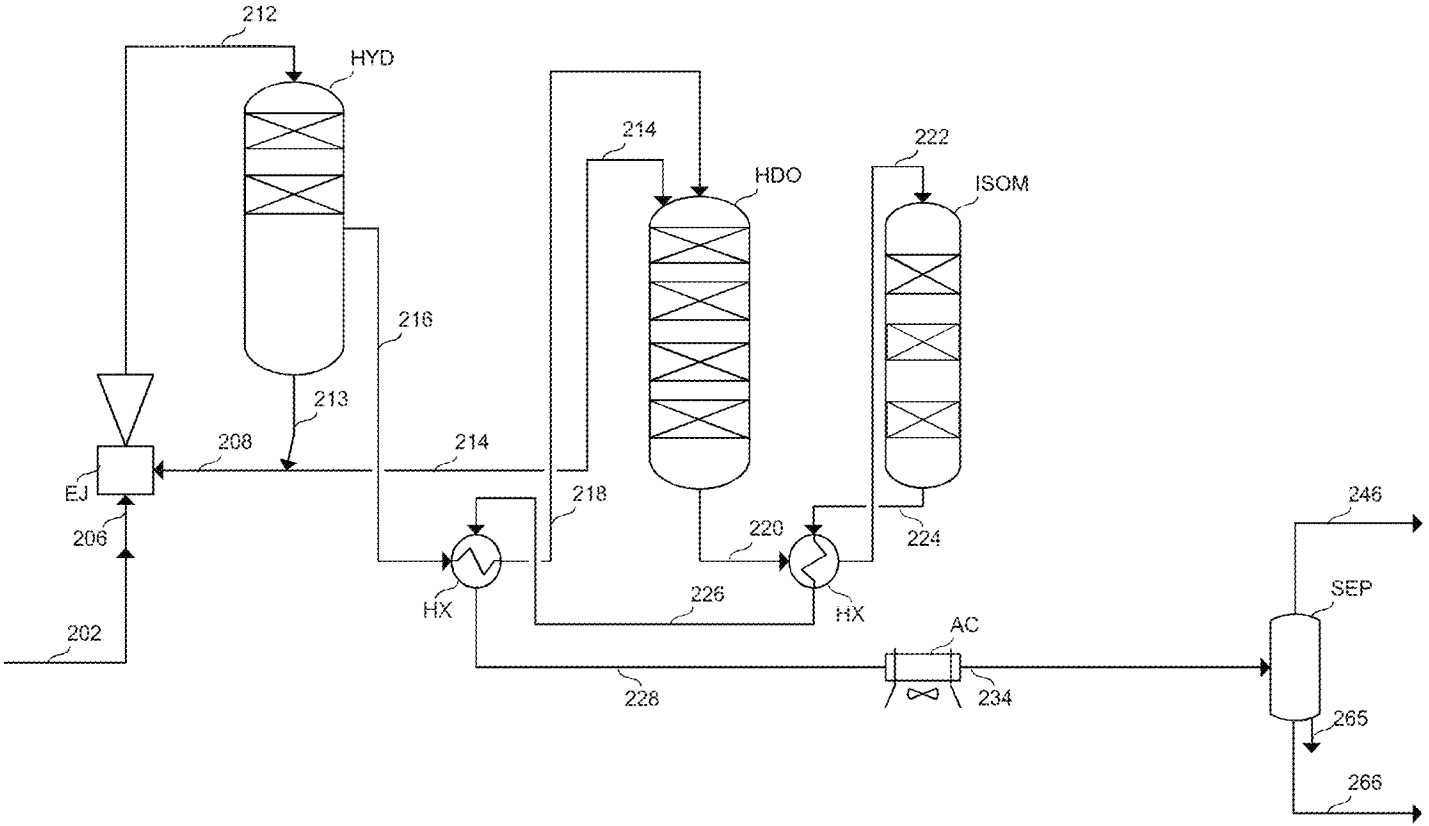
FIG. 2 shows a simplified diagram of the process of FIG. 1, focusing on liquid flows.

FIG. 2 shows a simplified process layout similar to FIG. 1, focusing on streams comprising hydrocarbons. Here an amount of pressurized reactive liquid feedstock (202) is directed as feedstock for hydrogenation (206), directed as motive stream to an ejector (EJ) receiving a diluent (208) as driven stream. The ejector discharge stream is directed as stabilization inlet stream (212) to a stabilization reactor (HYD) containing an amount of material catalytically active in hydrogenation of reactive species, under moderate conditions, such as an inlet temperature of less than 250° C. and a pressure from 3 to 20 MPa depending on the nature of the reactive liquid feed. The lower part of the stabilization reactor is here configured for withdrawal of an amount of liquid stabilized composition as diluent (208) and an amount of liquid stabilized composition to be directed as downstream diluent (214), but the recycled stabilized composition may also be separated outside the stabilization reaction (HYD). An amount of two phase stabilized composition (216) is withdrawn by overflow, heated and directed—optionally in combination with an amount of bypassed feedstock (204)—to further hydrotreatment in a hydrodeoxygenation reactor (HDO). The amount of overflow, may be controlled by flow control. The further hydrotreated reactive composition (220) is optionally heated and directed for hydroprocessing, here in an hydroisomerization reactor (ISOM), to provide a hydroprocessed hydrocarbon product (224), which may be cooled, here by heat exchange with inlet streams (216 and 220) to the upstream reactors (HDO and ISOM). The cooled hydroprocessed hydrocarbon product (228) is cooled and directed to a separation section (SEP), from which at least a gas phase (246), a product (266) and a purged water stream (265) are withdrawn.

Figure 3:
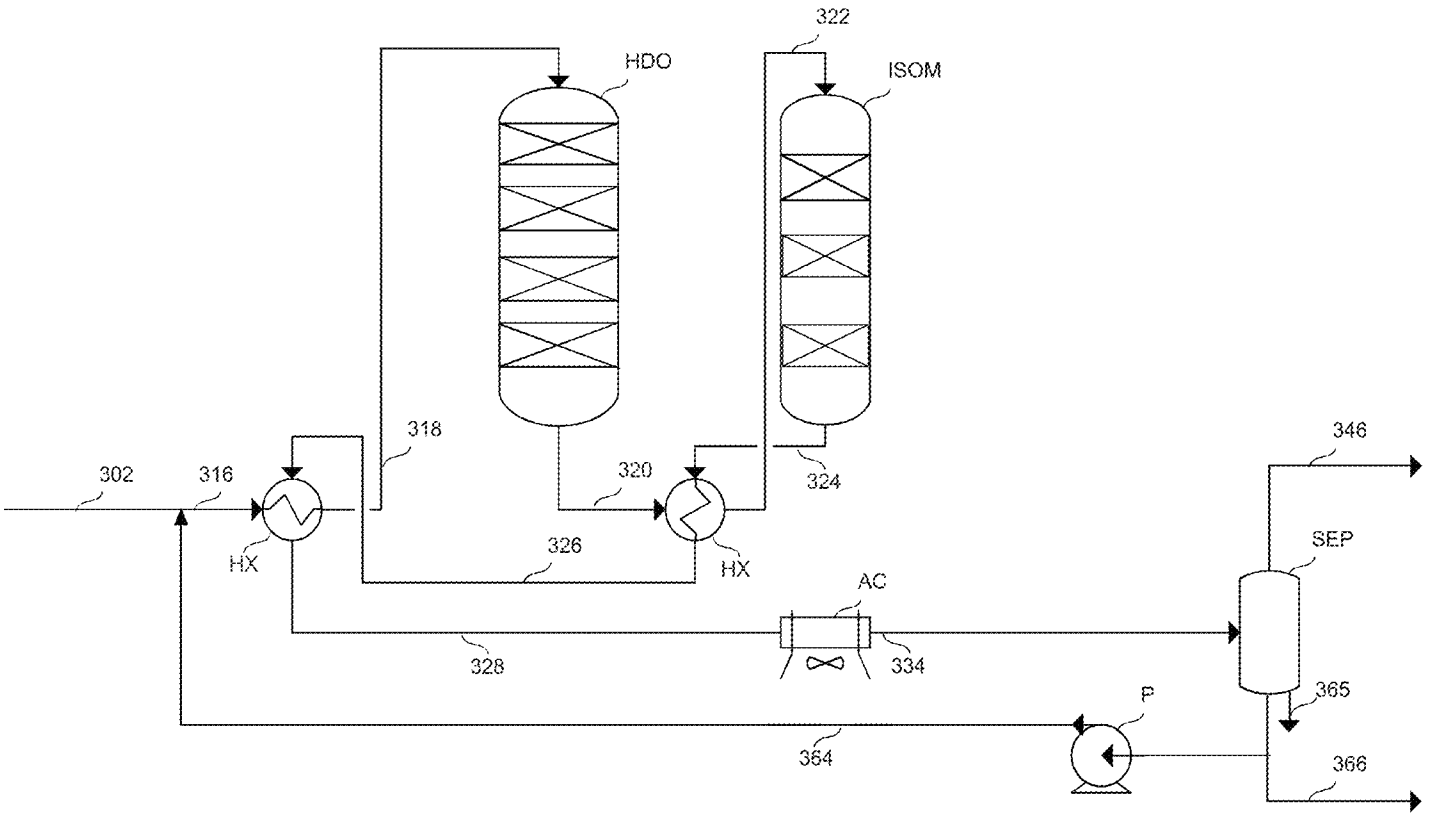
FIG. 3 shows a diagram of a process according to the prior art in a level of detail similar to FIG. 2.

FIG. 3 shows a simplified process layout according to the prior art, focusing on streams comprising hydrocarbons similar to FIG. 2. Here an amount of reactive liquid feedstock (302) is combined with a recycled product stream (364) and directed as feed hydrotreatment feed stream (318) to hydrotreatment in a hydrodeoxygenation reactor (HDO). The hydrotreated reactive composition (320) is optionally heated to a heated and directed for hydroprocessing, here in a hydroisomerization reactor (ISOM), to provide a hydroprocessed hydrocarbon product (324), which may be cooled, here by heat exchange with inlet streams (316 and 320) to the upstream reactors (HDO and ISOM). The cooled hydroprocessed hydrocarbon product (328) is cooled and directed to a separation section (SEP), from which at least a gas phase stream (346), a product stream (366) and a purged water stream (365) are withdrawn. An amount of the product stream is pumped as the recycled product stream (364)

Especially the first fractionator in all figures may beneficially be replaced by a stripper, which, especially if operating at elevated temperature and pressure, will reduced operational cost, as no or minimal re-heating and re-pressurization downstream the stripper would be required.

EXAMPLES

The effect of the revised process scheme is illustrated by two examples.

Example 1, according to the invention, involves a process according to FIG. 2, where a reactive pyrolysis oil feedstock is hydrogenated in a stabilization reactor, with recycle of the stabilized composition, by means of an ejector, followed by further hydrodeoxygenation.

In Table 1, flows and temperatures are presented for Example 1 (FIG. 2). The ratio between recycle and fresh feed is 2:1, It is seen that stream 212, and thus the stabilization reactor (HYD) must have a size corresponding to this combined flow, i.e. 3 times the size required without addition of recycle. The temperature out of the stabilization reactor is 260° C., but the remaining reactivity in the stabilized feedstock is sufficiently low, such that temperature control may be handled without a requirement for further recycle, in order to maintain hydrodeoxygenation temperature at a level where reaction runaway and catalyst coking are avoided. In the final reactor isomerization is carried out with a moderate exotherm of 22° C. The recycle is driven by a moderate loss of pressure of the feedstock over the injector from 8 MPa to 7 MPa, and the flow to the last two reactors is low.

Example 2, according to the prior art, involves a process according to FIG. 3, where the reactive feedstock is hydrogenated in the hydrodeoxygenation reactor, with product recycle, by means of a pump. in order to maintain hydrodeoxygenation temperature at a level where reaction runaway and catalyst coking are avoided.

In Table 2, flows and temperatures are presented for Example 2. The ratio between product recycle and feed to the hydrodeoxygenation reactor is 2:1. In the final reactor isomerization is carried out with a moderate exotherm of 22° C. In this example the feedstock pressure needs only to be 7 MPa. This layout avoids the stabilization reactor (HYD), but due to recycle the hydrodeoxygenation reactor and the isomerization reactors and other equipment significantly increased in size compared to example 1.

All in all, the process according to FIG. 3 requires one reactor less, but the total reactor volume, and thus the capital expenditure is higher. Furthermore, the energy requirement for the recycle oil pump will be higher than the energy requirement for pressurizer the feedstock to the ejector in the first example. The reduced volume of the last two reactors also result in savings for internals and guard bed volumes in these reactors, as well as smaller size of heat exchangers and other supporting equipment. The examples show that the temperature control is sufficient for the chemistry of the two examples to be similar.

TABLE 1

| Stream | Mass flow [kg/h] | Temperature [° C.] |
|---|---|---|
| 202 | 8,750 | 136 |
| 208 | 17,500 | 260 |
| 212 | 26,900 | 200 |
| 214 | 6,100 | 260 |
| 222 | 15,700 | 365 |
| 224 | 15,700 | 375 |

TABLE 2

| Stream | Mass flow [kg/h] | Temperature [° C.] |
|---|---|---|
| 302 | 8,750 | 136 |
| 364 | 17,500 | 60 |
| 318 | 33,100 | 300 |
| 322 | 33,100 | 365 |
| 324 | 33,100 | 385 |

The invention claimed is:

1. A process for conversion of a reactive liquid feedstock stream containing at least 40 wt % carbon into a stabilized composition, comprising the steps of a. directing a diluent stream and the reactive liquid feedstock stream as a combined stream having a first hydrogen consumption potential, to contact a material catalytically active in hydrotreatment which during operation has a lowest temperature of at least 80° C. and a highest temperature of less than 250° C. in the presence of dihydrogen, b. withdrawing a stabilized composition stream having a second combined hydrogen consumption potential which is less than 80% and more than 10% of the first hydrogen consumption potential, c. withdrawing a combined liquid and gas phase stream from the stabilized composition stream by overflow, and d. withdrawing an amount of a liquid phase of said stabilized composition stream by flow control and providing it as said diluent stream wherein the hydrogen consumption potential for a composition shall be understood as the amount of hydrogen required for conversion of the composition into a saturated hydrocarbon.

2. The process according to claim 1, in which the reactive liquid feedstock stream contains at least 5 wt % O.

3. The process according to claim 1, wherein the reactive liquid feedstock stream has a carbonyl content of at least 0.5 mol/kg.

4. The process according to claim 1, wherein step a is preceded by formation of the reactive liquid feedstock stream in a thermal decomposition process.

5. The process according to claim 1, wherein the diluent stream is directed as driven fluid to an ejector pump which receives a pressurized reactive liquid feedstock stream as motive fluid.

6. The process according to claim 1, wherein a total weight ratio between diluent stream and reactive liquid feedstock stream is at least 1:1.

7. The process according to claim 1, wherein the diluent stream is directed to contact the material catalytically active in hydrotreatment prior to being combined with the reactive liquid feedstock stream.

8. The process according to claim 1, wherein the diluent stream is cooled prior to being combined with the reactive liquid feedstock stream.

9. The process according to claim 1, wherein a stream comprising an amount of the liquid phase of said stabilized composition is directed to contact a further material catalytically active in hydrotreatment to provide a further hydrotreated composition optionally after combination with a further diluent stream having a hydrogen consumption potential below that of the stabilized composition stream.

10. The process according to claim 9, wherein the further hydrotreated composition stream is directed to contact a material catalytically active in hydroprocessing, optionally after withdrawal of a gas phase stream and combination with an amount of dihydrogen to provide a hydroprocessed hydrocarbon product stream.

11. A process plant configured for receiving a reactive liquid feedstock, the process plant comprising a stabilization reactor containing an amount of a material catalytically active in hydrotreatment and having an inlet, a bottom outlet and an overflow outlet, the bottom outlet being in fluid communication with a means of flow control, and at least one hydrotreatment reactor containing an amount of material catalytically active in hydrotreatment, having an inlet and an outlet, wherein the stabilization reactor is configured for receiving an amount of dihydrogen and configured for providing a stabilized composition according to claim 1, wherein the means of flow control is configurable for limiting the flow of liquid in the bottom outlet, such that an amount of combined gas and liquid will be directed to the overflow outlet, and wherein the inlet of the hydrotreatment reactor is configured for being in fluid communication with the overflow outlet of the stabilization reactor.

12. The process according to claim 1, further comprising e. directing the combined liquid and gas phase stream to contact a further material catalytically active in hydrotreatment to provide a further hydrotreated composition.

13. The process according to claim 12, wherein the further hydrotreated composition stream is directed to contact a material catalytically active in hydroprocessing, optionally after withdrawal of a gas phase stream and combination with an amount of dihydrogen to provide a hydroprocessed hydrocarbon product stream.

* * * * *